US007195139B2

(12) United States Patent
Jaworski et al.

(10) Patent No.: US 7,195,139 B2
(45) Date of Patent: Mar. 27, 2007

(54) DISPENSING VALVE

(75) Inventors: Thomas Jaworski, Racine, WI (US); Nathan R. Westphal, Union Grove, WI (US); Padma P. Varanasi, Racine, WI (US); Darren K. Robling, Racine, WI (US); Joel E. Adair, Racine, WI (US); Chris A. Kubicek, East Troy, WI (US)

(73) Assignee: S.C. Johnson & Son, Inc., Racine, WI (US)

( * ) Notice: Subject to any disclaimer, the term of this patent is extended or adjusted under 35 U.S.C. 154(b) by 439 days.

(21) Appl. No.: 10/880,210

(22) Filed: Jun. 29, 2004

(65) Prior Publication Data

US 2005/0284896 A1 Dec. 29, 2005

(51) Int. Cl.
*B65D 83/14* (2006.01)

(52) U.S. Cl. ..... 222/645; 222/1; 222/649; 222/189.06; 222/402.13; 222/402.18; 222/402.2

(58) Field of Classification Search ..... 222/402.1, 222/402.11, 402.13, 402.14, 1, 402.18, 402.2, 222/645, 649
See application file for complete search history.

(56) References Cited

U.S. PATENT DOCUMENTS

| | | | | |
|---|---|---|---|---|
| 3,305,134 | A | 2/1967 | Carmichael et al. | |
| 3,419,189 | A | 12/1968 | Iketani | |
| 3,477,613 | A | 11/1969 | Mangel | |
| 3,497,108 | A | 2/1970 | Mason | |
| 3,542,248 | A | 11/1970 | Mangel | |
| 3,658,209 | A | 4/1972 | Freeman et al. | |
| 3,664,548 | A | 5/1972 | Broderick | |
| 3,756,465 | A | 9/1973 | Meshberg | 222/61 |
| 4,077,542 | A | 3/1978 | Petterson | |
| 4,396,152 | A | 8/1983 | Abplanalp | |
| 5,018,963 | A | 5/1991 | Diederich | |
| 5,025,962 | A | 6/1991 | Renfro | |
| 5,337,929 | A | 8/1994 | van der Heijden | |
| 5,702,036 | A | 12/1997 | Ferraro, Jr. | |
| 5,791,524 | A | 8/1998 | Demarest | |
| 6,216,925 | B1 | 4/2001 | Garon | |
| 6,293,474 | B1 | 9/2001 | Helf et al. | |
| 6,478,199 | B1 | 11/2002 | Shanklin et al. | |
| 6,533,141 | B1 | 3/2003 | Petterson et al. | |
| 6,588,627 | B1 | 7/2003 | Petterson et al. | |
| 6,612,464 | B1 | 9/2003 | Petterson et al. | |
| 6,688,492 | B1 | 2/2004 | Jaworski et al. | |
| 6,837,396 | B1 * | 1/2005 | Jaworski et al. | 222/1 |
| 6,926,172 | B1 * | 8/2005 | Jaworski et al. | 222/153.12 |
| 2003/0080144 | A1 | 5/2003 | Jaworski et al. | 222/1 |

FOREIGN PATENT DOCUMENTS

| | | |
|---|---|---|
| EP | 826.608 | 3/1998 |

(Continued)

OTHER PUBLICATIONS

U.S. Appl. No. 10/236,634, filed Jul. 25, 2003.

*Primary Examiner*—J. Casimer Jacyna

(57) ABSTRACT

A valve assembly can automatically dispense aerosol content from an aerosol container at predetermined intervals without the use of electric power. A diaphragm at least partially defines an accumulation chamber that receives gas propellant from a portion of the can during an accumulation phase. Once the internal pressure of the accumulation chamber reaches a predetermined threshold, the diaphragm moves, carrying with it a seal so as to unseal an outlet channel, and thereby initiate a spray burst of the main active chemical. The diaphragm assumes its original position when the pressure within the accumulation chamber falls below a threshold pressure.

13 Claims, 9 Drawing Sheets

FOREIGN PATENT DOCUMENTS

| | | |
|---|---|---|
| JP | 56-37070 | 4/1981 |
| JP | 56-44060 | 4/1981 |
| JP | 56-44061 | 4/1981 |
| JP | 56-44062 | 4/1981 |
| JP | 56-70865 | 6/1981 |
| JP | 57-174173 | 10/1982 |
| JP | 03-085169 | 4/1991 |
| JP | 03-085170 | 4/1991 |
| JP | 10-216577 | 8/1998 |
| JP | 2001-048254 | 2/2001 |

* cited by examiner

DISPENSING VALVE

CROSS-REFERENCE TO RELATED APPLICATIONS

Not applicable

STATEMENT REGARDING FEDERALLY SPONSORED RESEARCH/DEVELOPMENT

Not applicable

BACKGROUND OF THE INVENTION

The present invention relates to aerosol dispensing devices, and in particular to valve assemblies that provide automatic dispensing of aerosol content at predetermined time intervals, without requiring the use of electrical power.

Aerosol cans dispense a variety of ingredients. Typically, an active is mixed with a propellant which inside the can is at least partially in a gas state, but may also be at least partially dissolved into a liquid containing active. Typical propellants are a propane/butane mix or carbon dioxide. The mixture is stored under pressure in the aerosol can. The active mixture is then sprayed by pushing down/sideways on an activator button at the top of the can that controls a release valve.

For purposes of this application, the term "active chemical" is used to mean that portion of the content of the container (regardless of whether in emulsion state, single phase, or multiple phase), which is in liquid phase in the container (regardless of phase outside the container) and has a desired active such as an insect control agent (repellent or insecticide or growth regulator), fragrance, sanitizer, and/or deodorizer alone and/or mixed in a solvent, and/or mixed with a portion of the propellant.

Pressure on a valve control button is typically supplied by finger pressure. However, for fragrances, deodorizers, insecticides, and certain other actives which are sprayed directly into the air, it is sometimes desirable to periodically refresh the concentration of active in the air. While this can be done manually, there are situations where this is inconvenient. For example, when an insect repellant is being sprayed to protect a room overnight (instead of using a burnable mosquito coil), the consumer will not want to wake up in the middle of the night just to manually spray more repellant.

There a number of prior art systems for automatically distributing actives into the air at intermittent times. Most of these rely in some way on electrical power to activate or control the dispensing. Where electric power is required, the cost of the dispenser can be unnecessarily increased. Moreover, for some applications power requirements are so high that battery power is impractical. Where that is the case, the device can only be used where linkage to conventional power sources is possible.

Other systems discharge active intermittently and automatically from an aerosol can, without using electrical power. For example, U.S. Pat. No. 4,077,542 relies on a biased diaphragm to control bursts of aerosol gas at periodic intervals. See also U.S. Pat. Nos. 3,477,613 and 3,658,209. However, some biased diaphragm systems have suffered from reliability problems (e.g. clogging, leakage, uneven delivery). Moreover, they sometimes do not securely attach to the aerosol can.

Moreover, the cost of some prior intermittent spray control systems makes it impractical to provide them as single use/throw away products. For some applications, consumers may prefer a completely disposable product.

Particularly of concern, dispensing devices permit liquid with active to pass through a variety of narrow control passages in the valve. Over time, this can lead to clogging of the valve, and thus inconsistent operation.

In U.S. Pat. No. 4,396,152 an aerosol dispensing system was proposed which separately accessed the vapor and liquid phases of the material in the container. However, this device did not achieve reliable automatic operation. Our laboratory has also developed a variety of dispensing devices that provide for automatic intermittent dispensing without use of electrical power. See generally U.S. Pat. Nos. 6,478,199, 6,533,141, 6,588,627, 6,612,464, and 6,688,492, as well as U.S. Ser. No. 10/236,634 filed on Jul. 25, 2003. The disclosure of each of these applications is incorporated by reference as if fully set forth herein. While these devices provided significant improvements, it is desirable to achieve even greater reliability by avoiding clogs when dispensing certain types of chemicals that are particularly susceptible to clogging automated devices.

Thus, a need still exists for improved, inexpensive automated aerosol dispensers that do not require electrical power.

BRIEF SUMMARY OF THE INVENTION

In one aspect the invention provides a valve assembly that is suitable to dispense an active chemical from an aerosol container where the container has a first region holding a gas propellant and a second region holding an active chemical. The assembly is of the type that can automatically transition from an accumulation phase where the gas is received from the container, to a spray phase where the active chemical is automatically dispensed at intervals.

The regions need not be physically separated from each other. In fact, the preferred form is that the first region be an upper region of the can where propellant gas has collected above a liquid phase of the remainder of the can contents.

There is a housing mountable on an aerosol container. A movable diaphragm is associated with the housing and linked to a seal, the diaphragm being biased towards a first configuration. An accumulation chamber is inside the housing for providing variable pressure against the diaphragm. A first passageway in the housing is suitable for linking the first region of the aerosol container with the accumulation chamber, and a second passageway links the second region with an outlet of the valve assembly. A fluid filter is adjacent to an inlet to the first passageway inhibiting liquid stored in the container from entering the first passageway. An orifice plate is disposed in the first passageway to regulate the flow of gas therethrough.

When the diaphragm is in the first configuration the seal can restrict the flow of active chemical out the valve assembly. When the pressure of chemical inside the accumulation chamber exceeds a specified threshold, the diaphragm can move to a second configuration where the active chemical is permitted to spray from the valve assembly.

In preferred forms diaphragm shifts back to the first configuration from the second configuration when pressure of the gas propellant in the accumulation chamber falls below a threshold amount, the accumulation chamber will exhaust the gas when the diaphragm is in the second configuration, and the gas propellant and active chemical may mix in the valve assembly outside of the can and exit as a merged stream. Alternatively, the active chemical and gas propellant may exit the dispenser as separate streams.

In another form the fluid filter can be hydrophobic, and possibly also oleophobic. The fluid filter can be made from a variety of materials used for filtering purposes and having these characteristics, such as those sold as Emflon®, Versapor®, Supor®, Metrice®, Durapore®, and Timonium® brand filters.

In another preferred form, the orifice plate defines at least one orifice having a smallest cross-sectional diameter between 0.2 microns and 0.45 microns (corresponding to a lateral cross-sectional area between 0.03 and 0.16 microns$^2$). The orifice plate preferably comprises an electroplated nickel.

Methods for using these valve assemblies with aerosol containers are also disclosed.

The present invention achieves a secure mounting of a valve assembly on an aerosol can, yet provides an actuator that has two modes. In one mode the valve assembly is operationally disconnected from the actuator valve of the aerosol container (a mode suitable for shipment or long-term storage). Another mode operationally links the valve assembly to the aerosol container interior, and begins the cycle of periodic and automatic dispensing of chemical there from. The periodic operation is achieved without requiring the use of electrical power to motivate or control the valve.

The valve assembly has few parts, and is inexpensive to manufacture and assemble. Moreover the separate accessing of the gas propellant lets the gas (as distinguished from more viscous liquid) motivate the diaphragm and thus provides for cleaner and more reliable operation. By preventing substantial amounts of liquid from entering the propellant passageway, there is much less likelihood for clogging due to extended use over months. Furthermore, the orifice plate enables precise metering of accumulation phase intervals.

Using the separation concepts described in this patent, product is released under high pressure with liquid propellant (as in a typical manually operated aerosol can), so as to provide for very effective particle break-up. If the propellant gas was not separated from the main product, it might separate in the accumulation chamber or elsewhere in the device, thereby providing inconsistent results.

The foregoing and other advantages of the present invention will be apparent from the following description. In the description reference is made to the accompanying drawings which form a part thereof, and in which there is shown by way of illustration, and not limitation, preferred embodiments of the invention. Such embodiments do not necessarily represent the full scope of the invention, and reference should therefore be made to the claims herein for interpreting the scope of the invention.

DETAILED DESCRIPTION OF THE PREFERRED EMBODIMENT

Figure 1:
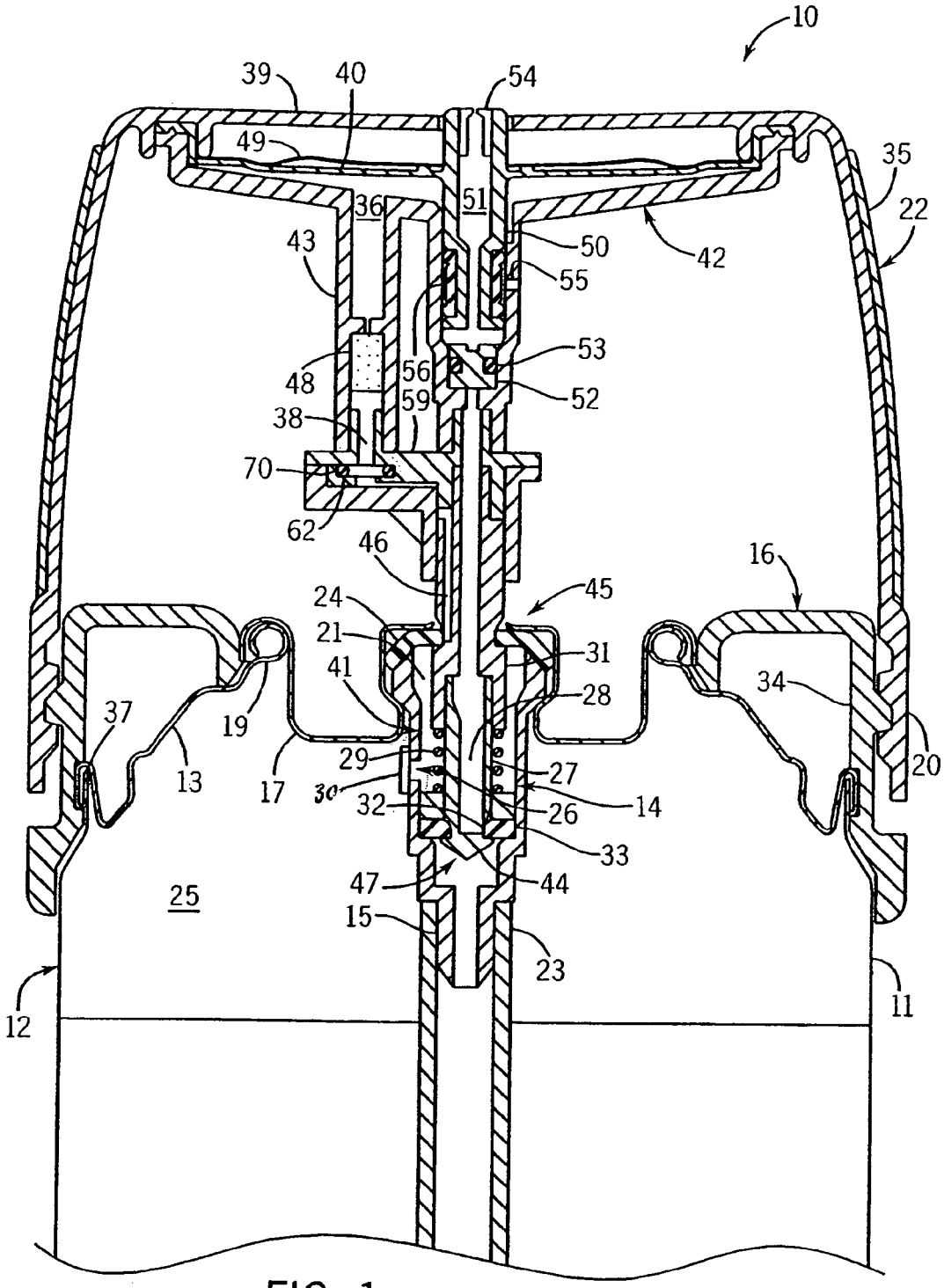
FIG. 1 is a schematic sectional view of a first automated dispensing valve assembly of the present invention, in an off configuration, mounted on an aerosol can.

Referring initially to FIG. 1, an aerosol can 12 includes a cylindrical wall 11 that is closed at its upper margin by a dome 13. The upper margin of the can wall 11 is joined at a can chime 37. An upwardly open cup 17 is located at the center of the dome 13 and is joined to the dome by a rim 19.

The can 12 includes an axially extending conduit 23 that is centrally disposed therein, and opens into a mixed pressurized chemical (active and gas propellant) at one end (preferably towards the bottom of the can). The upper region 25 of the can interior above the active chemical line contains pressurized gas propellant. The lower region contains a mix of liquid gas and the active chemical. The upper end of conduit 23 receives a tee 15 that interfaces with the interior of a dispenser 10, through which the chemical may be expelled.

Dispenser 10 includes a can valve assembly 45 that, in turn, includes a gas propellant valve assembly 41 and an active valve assembly 47. Dispenser 10 permits aerosol content to be automatically expelled into the ambient environment at predetermined intervals, as will be described in more detail below. Dispenser 10 can be primarily made of polypropylene, albeit other suitable materials can be used for the primary material.

A mounting structure 16 is snap-fit to the valve cup rim 19 at its radially inner end, and to the can chime 37 at its radially outer end. The radially outer wall 34 of mounting structure 16 extends axially, and is threaded at its radially outer surface. The dispenser 10 has a radially outer wall 35 that includes a lower skirt portion 20 which forms part of a control assembly 22.

Skirt 20 has threads disposed on its radially inner surface that intermesh with threads on outer wall 34 to rotatably connect the dispenser 10 to the aerosol can 12. The axially outer end of wall 35 terminates at a radially extending cover having a centrally disposed outlet that contains a dispensing nozzle 54 which enables active to be sprayed out the dispenser 10 at predetermined intervals, as will be described in more detail below. In operation, the dispenser 10 may be switched "ON" and "OFF" by rotating member 22 relative to the can 12, as will be apparent from the description below.

It should be appreciated that throughout this description, the terms "axially outer, axially downstream, axially inner, axially upstream" are used with reference to the longitudinal axis of the container. The term "radial" refers to a direction outward or inward from that axis.

Figure 2:
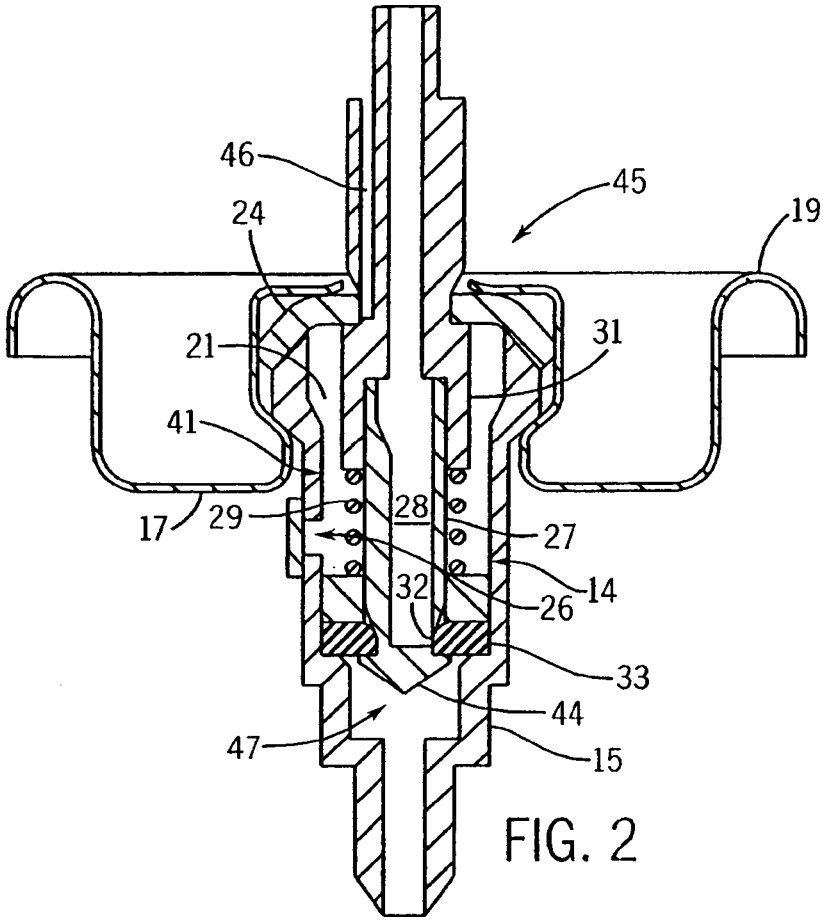
FIG. 2 is an enlarged view of the can valve portion of the dispensing valve assembly of FIG. 1.

Referring mostly to FIG. 2, the tee 15 defines an interior cavity 14 disposed axially downstream from conduit 23. Tee 15 is sized so as be to crimped within the center of the open end of cup 17. An elongated annular wall 27 defines a first conduit 28 that extends axially from the interior of cavity 14 and centrally through the dispenser 10 to deliver the active mixture from the can 12 the dispensing nozzle 54. An elongated valve stem 31 extends axially downstream from wall 27 into the dispenser 10, and enables thus enables conduit 28 to extend into the dispenser.

An inlet 26 extends radially through tee 15 between cavity 14 and gaseous collection portion 25 at a location slightly below cup 17. Inlet 26 is linked to a passageway 21 extending between cavity 14 and gaseous collection portion 25, and provides a propellant intake channel, as will become more apparent from the description below.

Advantageously, in accordance with the present invention, a hydrophobic and oleophobic fluid filter membrane 30 is attached to the outer surface of tee 15. Membrane 30 completely covers inlet 26 and prevents liquid from entering passageway 21 when, for instance, can 12 is held upside down or at an angle that would otherwise allow active liquid to flow into inlet 26. A similar membrane 130 is described in more detail below with reference to FIG. 8.

A propellant delivery channel 46 extends axially through conduit 31, and connects cavity 14 with an accumulation chamber 36 that receives propellant. As will be described in more detail below, the internal pressure of accumulation chamber 36 determines whether the dispenser 10 is in a spray phase or an accumulation phase.

Valve stem 31 exerts pressure against gasket 33 via a spring member 29. Wall 27 provides a plunger that extends axially upstream from the axially inner end of valve stem 31, and terminates at a seal 44 that is biased against the gasket 33. When the dispenser is "OFF," (See FIG. 2) the spring force biases seal 44 against the gasket 33, thereby preventing active from flowing into channel 28. Furthermore, valve stem 31 is biased against a gasket 24 proximal the outer end of can 12 to provide a seal there between, thus preventing the flow of propellant from can 12 into passageway 46. Accordingly, neither gas propellant nor active mixture is permitted to flow from the can 12 into the dispenser at this time. The dispenser 10 is thus in a storage/shipment position.

A channel 32 extends through the surface of wall 27 proximal the seal 44 to enable the active to flow into the dispenser 10 when the dispenser is in an "ON" configuration, as will be described in more detail below.

Figure 3:
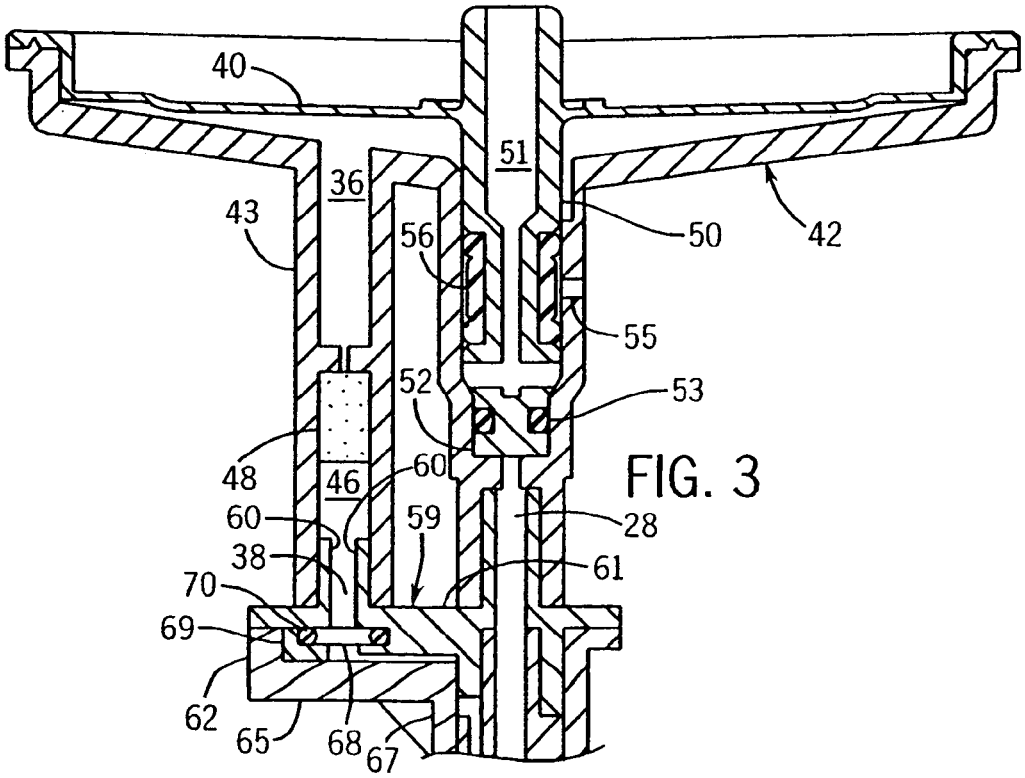
FIG. 3 is an enlarged view of the dispensing portion of the dispensing valve assembly of FIG. 1.

Referring now also to FIG. 3, the axially outer end of valve stem 31 terminates at a centrally disposed inlet to a retainer wall 42 that, in turn, connects to an axially extending annular conduit 50. Conduit 50 extends outwardly to nozzle 54, and provides an outlet channel 51 to deliver active to the ambient environment. A plug 52 is disposed at the inner end of channel 51, and is sealed by a seal surface 53, which may be an o-ring, to prevent pressurized active from flowing out the dispenser 10 when the dispenser is not in a "SPRAY" phase, as will be described in more detail below.

Conduit 46 extends radially outwardly proximal the junction between conduits 50 and 31, and opens at its axially outer end into a propellant inlet 38 of retainer wall 42. Inlet 38 is defined by a cylindrical conduit 43 of retainer wall 42 that extends substantially parallel to, and is spaced from, conduit 50. The diameter of inlet 38 is defined by a first wall 59 having an upper flange 60 extending into conduit 43, and a radial portion 61 extending radially outward from both sides of conduit 43. The inner end of radial portion 61 is coupled to conduit 50. The outer end of radial portion 61 is coupled to the outer end of a support wall 62 that has a radial section 65 coupled to a downwardly extending axial portion 67.

The inner end of radial portion 61, along with an outer embedded wall 69 disposed between walls 59 and 62, provides a seat for a flow restricting orifice plate 68 at inlet 38. Orifice plate 68 can comprise any conventional material suitable for its purpose, but is preferably comprised of an electroplated nickel cobalt composition formed upon a photoresist substrate which is subsequently removed in the conventional manner to reveal a uniform porous structure of nickel cobalt having a thickness between 10 and 100 microns, and preferably of 50 microns.

Figure 5:
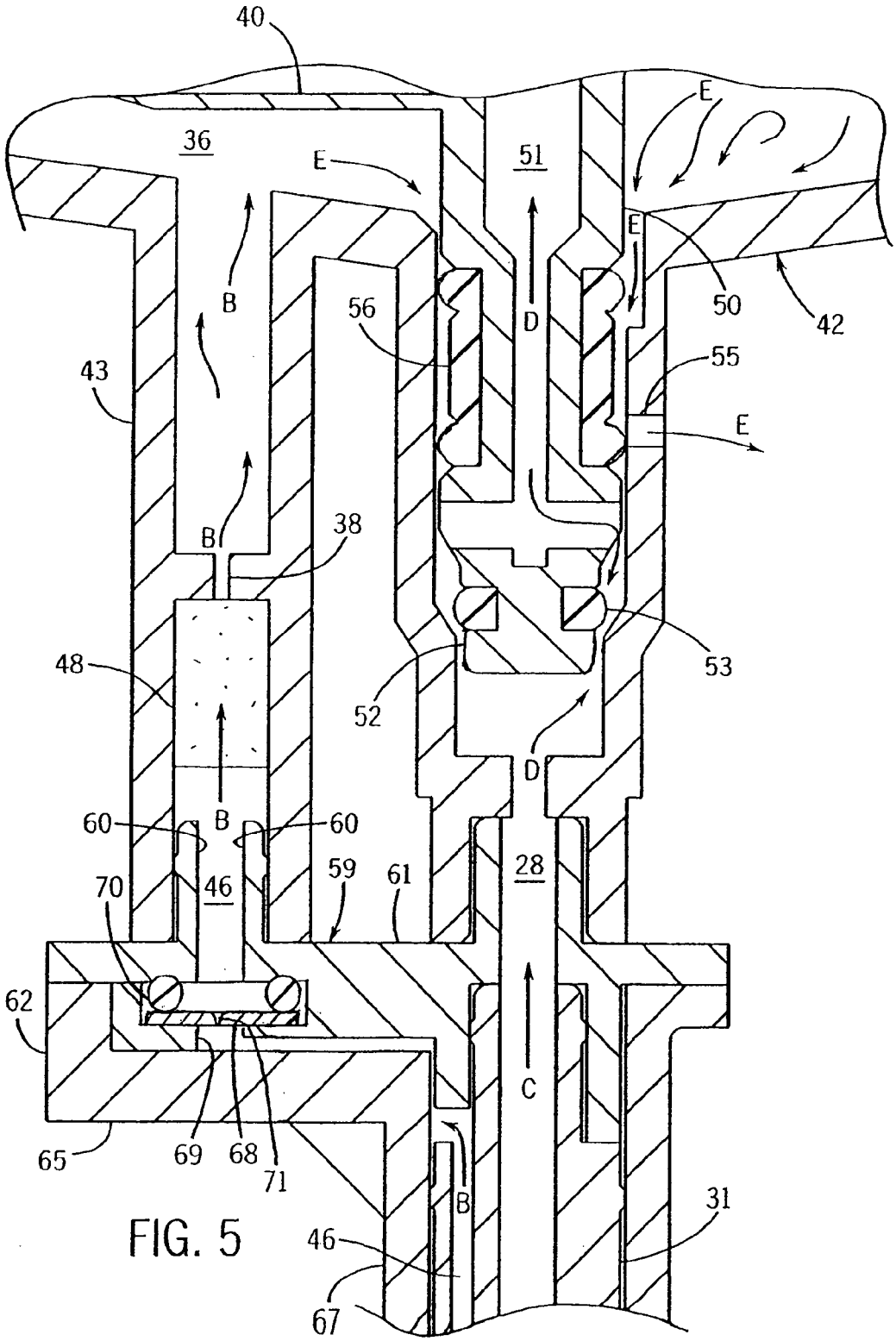
FIG. 5 is a further enlarged view of a portion of the FIG. 1 device, but with the device shown in a spray phase.

As best seen in FIG. 5, by forming the nickel cobalt layer through electroplating, a porous structure having the contour of the photoresist substrate may be produced, in which permeability is achieved by formation of at least one curved, diverging (in the direction of fluid flow) aperture 71 extending axially there through. The orifice plate 68 is sealed against the adjacent structure via an o-ring 70.

Figure 7:
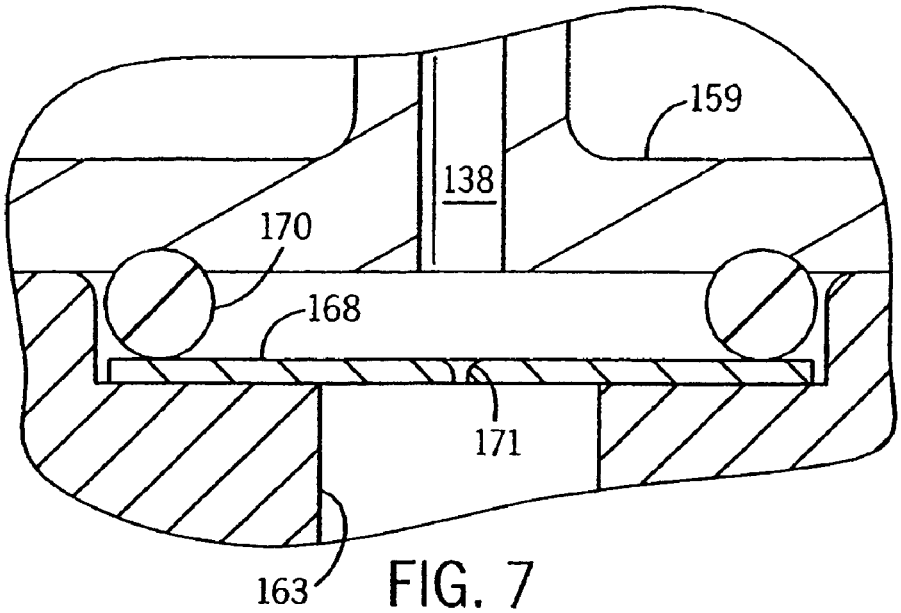
FIG. 7 is a highly enlarged view of a portion of the FIG. 6 device that includes a metering orifice plate.

The at least one aperture 71 can be described as having a diameter of between 0.2 microns and 0.45 microns, and more preferably approximately 0.25 microns at its most narrow (upstream) end (see also FIG. 7 for an analogous structure in a second embodiment). The at least one aperture 71 can further be defined as having a lateral cross-sectional area between 0.03 and 0.16 microns and more preferably approximately 0.05 microns$^2$ at its most narrow (upstream) end. Aperture 71 is precisely sized to permit a flow of propellant into accumulation chamber 36 at a predetermined metered rate that causes dispenser to iterate between spray phases at a predetermined time interval.

It should be appreciated that when using an extremely small diameter aperture like aperture 71 (to achieve precise rate control), absent other structures there would be a tendency of the valve to clog with some chemicals. Thus, the inclusion of the filter upstream of this aperture which effectively allows only gas to reach the aperture is highly important to proper operation of the valve.

Accumulation chamber 36 is defined by retainer wall 42 that, in combination with a flexible, mono-stable diaphragm 40, encases the accumulation chamber 36. Diaphragm 40 comprises an annular plate that is supported at its outer surface by an annular spring member 49 that biases the diaphragm 40 towards the closed position illustrated in FIG. 1.

The diaphragm 40 is movable between the first closed position (FIG. 4) and a second open position (FIG. 5) to activate the dispenser 10 at predetermined intervals, as will be described in more detail below. A porous media 48, which is preferably made of a low porosity ceramic or any other similarly permeable material, can further be disposed in conduit 43 if desired.

The radially outer edge of diaphragm 40 extends into a groove formed on the radially inner surface of cover 39 at its axially outer end. The radially inner edge of diaphragm is integrally connected to conduit 50.

Conduit further includes a propellant vent 55 extending through its outer wall that enables propellant to escape during the spray phase, as will be described in more detail below. The vent 55 is sealed by an elongated sleeve 56 that prevents the escape of propellant during the accumulation phase.

Figure 4:
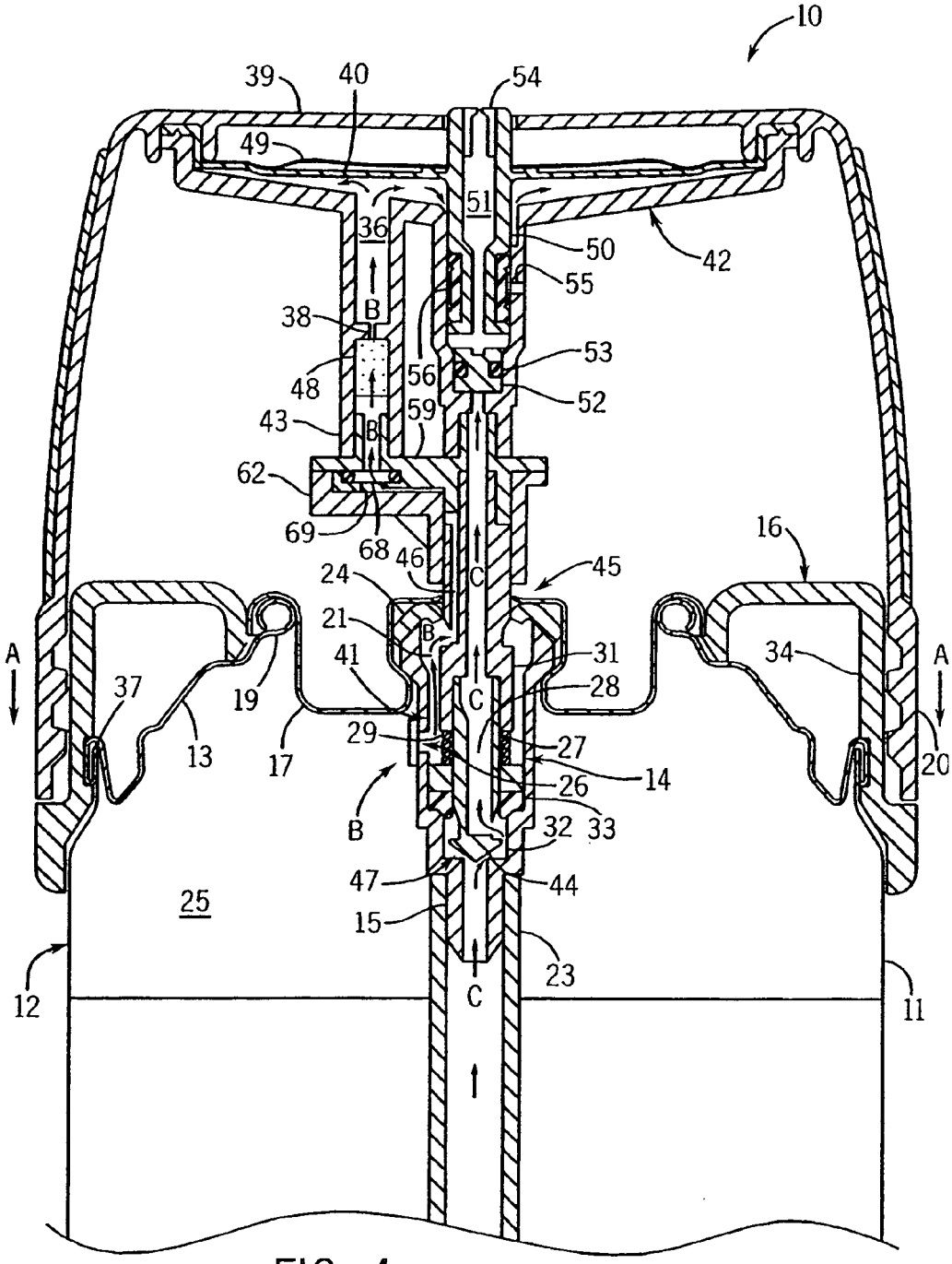
FIG. 4 is a view similar to FIG. 1, with the device shown in the on configuration, during an accumulation phase.

Referring now to FIG. 4, the dispenser is turned "ON" by rotating the control assembly 22 is rotated to displace the dispenser 10 axially inwardly along the direction of arrow A.

It should be appreciated that the compliance of spring 29 minimizes the risk of damage to the dispenser 10 due to over-rotation by the user. Also, there is a shoulder feature on the element 16 to act as an additional stop. The valve stem 31 is displaced downward, thereby compressing spring 29 to displace the seal 44 axially upstream and away from gasket 33. The displacement of valve stem 31 furthermore removes the seal 24.

An accumulation phase is thereby initiated, in which the pressurized gas propellant flows from the can 12 downstream along the direction of arrow B through cavity 14 and into channel 46. The propellant then travels into the inlet 38 of accumulation chamber 36 via aperture 71 extending through orifice plate 36, where it can be further regulated, if desired, by porous flow control media 48 before flowing into the accumulation chamber 36.

Once the control assembly 22 has been rotated to turn the dispenser 10 "ON," pressurized active mixture is also able to exit the can 12. In particular, the active flows through conduit 23, and around the seal 44 into channel 28, where it continues to travel along the direction of Arrow C towards outlet channel 51. However, because plug 52 is disposed at the mouth of channel 51, the active is unable to travel any further during downstream.

During the accumulation phase, the constant supply of gas propellant flowing from intake channel 46 into the accumulation chamber 36 causes pressure to build therein, and such pressure acts against the inner surface of diaphragm 40. Once the accumulation chamber 36 is sufficiently charged with gas propellant, such that the pressure reaches a predetermined threshold, the mono-stable diaphragm 40 becomes deformed from the normal closed position illustrated in FIG. 4 to the open position illustrated in FIG. 5.

This initiates a spray phase, during which the diaphragm 40 causes conduit 50 to become displaced axially outwardly. As conduit 50 becomes displaced outwardly, plug 52 becomes removed from channel 28. Accordingly, because the inner diameter of retainer wall 42 increases as plug 52 travels downstream, the active mixture is permitted to travel from conduit 28, around the plug, and into outlet channel 51 along the direction of Arrow D.

The pressurized active then travels from channel 51 and out the nozzle 54 as a spray. It should be appreciated that the seal between the inner end of sleeve 56 and the inner surface of retainer wall 42 upstream of propellant vent 55 is maintained during the spray phase, thereby preventing the active mixture from exiting the dispenser through the vent 55.

The displacement of wall 50 further removes the outer seal of sleeve 56 from the inner surface of retainer wall 42, thus enabling the pressurized gas propellant that was stored in the accumulation chamber 36 during the previous accumulation cycle, along with gas propellant entering into accumulation chamber 36 during the spray phase, to exit the accumulation chamber via vent 55 along the direction of Arrow E. Because the outer wall 35 is not air tight, propellant is able to exit the dispenser 20 from vent 55. Because more gas propellant exits accumulation chamber 36 than propellant that enters via orifice plate 38, the pressure within the accumulation chamber quickly abates during the spray phase.

Once the pressure within chamber 36 falls below a predetermined threshold, the diaphragm 40 snaps back to its normal closed position, re-establishing the seal formed by plug 52 with respect to channel 28. Accordingly, active mixture is once again prevented from exiting the dispenser, while gas propellant continues to flow into the accumulation chamber 36 in the manner described above to initiate the next spray phase. The cycle is automatic and continuously periodic until the propellant is exhausted.

It should be appreciated that the dispenser 10 and can 12 may be sold to an end user as a pre-assembled unit. In operation, the user rotates the assembly 22 to displace the valve assembly 45 axially inwardly, thereby causing the aerosol contents to flow out of can 12, and beginning the accumulation cycle. The gas propellant flows through conduit 46 and into the accumulation chamber 36. Once the spray phase is initiated, the active mixture flows through conduit 51, and exits the nozzle 54 as a "puff" into the ambient environment. Advantageously, because no active chemical enters the accumulation chamber 36, liquid "pooling" within the accumulation chamber is prevented, and any tendency of the active to clog passageways associated therewith is avoided.

The duration of the accumulation phase may be controlled, for example, by adjusting the stiffness of diaphragm 40, the internal volume of chamber 36, and/or the porosity of porous flow media 48. The duration of the spray phase may be controlled, for example, by modifying the clearance between the recessed portion 56 and inner wall 42, and the porosity of flow control media 48, thereby controlling the depressurization time of chamber 36. Other modifications can be made by modifying the diameter of the vent 55, changing spring pressure, or the addition of greater amounts of or different flow control media.

Figure 6:
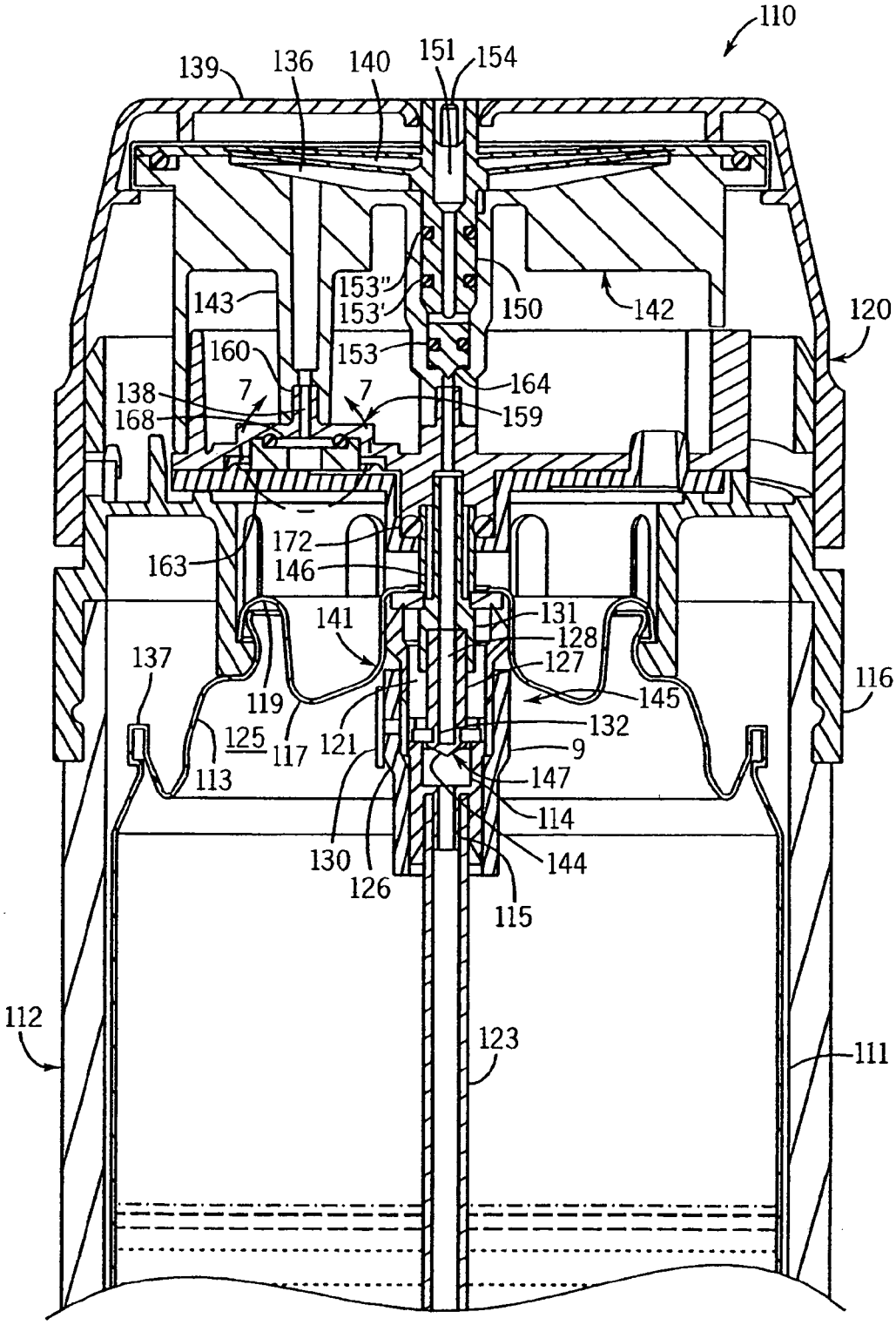
FIG. 6 is a sectional view similar to FIG. 1, but of an automatic dispensing valve assembly of an alternate embodiment.

Referring now to FIG. 6, a dispenser 110 is illustrated in accordance with the concepts described above with reference to dispenser 10. Dispenser 110 has some structural differences with respect to dispenser 10, however. The elements of dispenser 110 that correspond to dispenser 10 are identified by reference numerals incremented by 100 for the purposes of clarity and convenience.

In particular, aerosol can 112 includes a cylindrical wall 111 that is closed at its upper margin by a dome 113. The upper margin of the can wall 111 is joined at a can chime 137. An upwardly open cup 117 is located at the center of the dome 113 and is joined to the dome by a rim 119.

The can 112 includes an axially extending conduit 123 that is centrally disposed therein, and opens into a mixed pressurized chemical (active and gas propellant) at one end (preferably towards the bottom of the can). The upper region 125 of the can interior above the active chemical line contains pressurized gas propellant. The lower region contains a mix of liquid gas and the active chemical. The upper end of conduit 123 receives a tee 115 that interfaces with the interior of a dispenser 110, through which the chemical may be expelled.

Dispenser 110 includes a can valve assembly 145 that, in turn, includes a gas propellant valve assembly 141 and an active valve assembly 147. Dispenser 110 permits aerosol content to be automatically expelled into the ambient environment at predetermined intervals, as will be described in more detail below. Dispenser 110 is mostly polypropylene, albeit other suitable materials can be used.

A mounting structure 116 is snap-fit to the valve cup rim 119 at its radially inner end, and to the can chime 137 at its radially outer end. The radially outer wall 134 of mounting structure 116 extends axially, and is threaded at its radially outer surface. The dispenser 110 has a radially outer wall 135 that includes a lower skirt 120. Skirt extends to a radially extending cover having a centrally disposed outlet that contains a dispensing nozzle 154 which enables active to be sprayed out the dispenser 110 at predetermined intervals, as will be described in more detail below. In operation, the dispenser 110 may be switched "ON" and "OFF" in the conventional manner.

Tee 115 defines an interior cavity 114 disposed axially downstream from conduit 123. Tee 115 is sized so as be to crimped within the center of the open end of cup 117. An elongated annular wall 127 defines a first conduit 128 that extends axially from the interior of cavity 114 and centrally through the dispenser 110 to deliver the active mixture from the can 112 the dispensing nozzle 154.

Conduit 128 is blocked by a plug 164 when dispenser is not in the "spray" phase. An elongated valve stem 131 extends axially downstream from wall 127 into the dispenser 110, and enables thus enables conduit 128 to extend into the dispenser.

An inlet 126 extends radially through tee 115 and a surrounding outer wall 9, and links cavity 114 and gaseous collection portion 125 at a location slightly below cup 117. Inlet 126 is linked to a passageway 121 extending between cavity 114 and gaseous collection portion 125, and provides a propellant intake channel, as will become more apparent from the description below.

Figure 8:
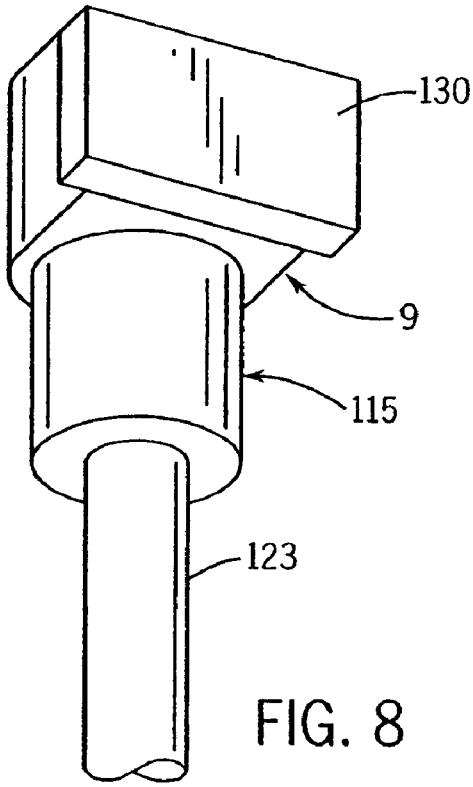
FIG. 8 is a perspective view of a valve portion of the FIG. 6 device including a filter media.

Referring now also to FIG. 8, a hydrophobic and also preferably oleophobic, fluid filter membrane 130 is advantageously attached (preferably adhesively attached) to the outer surface of tee 115. Membrane 130 completely covers inlet 126 and prevents liquid from entering passageway 121 when, for instance, can 112 is held upside down or at an angle that would otherwise allow active liquid to flow into inlet 126. In this sense, membrane 130 can be said to allow the passage of gas while filtering fluid, and can further be said to separate liquid from the gas that enters tee 115.

The terms "hydrophobic" and "oleophobic" as used herein refer to materials resistant to binding to water and oil, respectively. Hence, passage of water and oil into the passage downstream from the filter are resisted not only by the filter size, but also its material.

Preferably, membrane 130 has a high fluorine content that causes the membrane to be both hydrophobic and oleophobic. Small pore sizes through membrane 130 are desired in order to produce a higher wetting pressure (i.e., the pressure required to flood the pores). A pore size between 0.2 micron and 0.45 micron has been found suitable, however lower pore sizes (i.e., within the 0.2–0.3 micron range) have been found to be preferable. Advantageously, the pose sizes have a negligible effect on gas flow rate through inlet 126 due to the large surface are of the membrane and high pore density. One example of a suitable membrane material is Emflon® PTFE (polytetrafluoroethylene) commercially available from W. L. Gore. Emflon® has a polypropylene backing and a pore size between 0.02 and 0.2 micron pore size.

Another example of a suitable material is Versapor® R, which is a modified acrylic copolymer cast on a non-woven nylon support. It is treated with a fluorocarbon monomer and cross-linked using irradiation. The resulting membrane is both hydrophobic and oleophobic.

Another suitable material is Supor® which is similar to Versapor® R, albeit the base polymer is polyether sulfone. Yet another suitable material is Metricel® which is extruded pure polypropylene with a 0.1 micron pore diameter. Metricel® is hydrophobic but not oleophilic.

Yet another suitable material is Duraport® which is made of polyvinylidene fluoride, and is more hydrophobic than polypropylene and less hydrophobic than PTFE.

Still another suitable material is Timonium® which is a filter made of polypropylene melt-blown fibers, and operates as a depth filter defining pores not based on an aperture extending through the sheet, but rather from a web of fibers creating a tortuous path.

A propellant delivery channel 46 extends axially through conduit 131, and connects cavity 114 with accumulation chamber 136 that receives propellant. As described above, the internal pressure of accumulation chamber 136 determines whether the dispenser 110 is in a spray phase or an accumulation phase.

A channel 132 extends through the surface of wall 127 proximal a seal 144 to enable the active to flow into the dispenser 110 when the dispenser is in the "ON" configuration.

The axially outer end of valve stem 131 terminates at a centrally disposed inlet to a retainer wall 142 that, in turn, connects to an axially extending annular conduit 150. Conduit 150 extends outwardly to nozzle 154, and provides an outlet channel 151 to deliver active to the ambient environment. Plug 164 is disposed at the inner end of channel 151, and is sealed by one of a plurality of o-rings 153–153" that prevents pressurized active from flowing out the dispenser 110 when the dispenser is not in the "SPRAY" phase. The middle o-ring 153' is disposed radially inwardly with respect to the outer o-ring 153".

Conduit 146 extends parallel to, and is radially spaced from, conduit 128, and extends past an o-ring 172 before turning outwards towards a propellant inlet 138. Inlet 138 is disposed in a cylindrical conduit 143 of retainer wall 142. Conduit 43 extends substantially parallel to, and is spaced from, conduit 50.

The diameter of inlet 138 is defined by an annular wall 159 having an upper flange 160 extending into conduit 143. A support wall 162 extends radially beneath wall 159, and provides a seat for an annular coupling 163 whose interior is aligned with the outlet of flow path 146 and links flow path 146 to inlet 138. Coupling 163 further provides a seat for a flow restricting orifice plate 168 of the type described above. Orifice plate 168 is sealed against the undersurface of wall 159 via an o-ring 170

Accumulation chamber 136 is defined by retainer wall 142 that, in combination with a flexible, mono-stable diaphragm 140, encases the accumulation chamber 136. Accumulation chamber 136 further defines a notch 173 at its base that enables stored propellant to flow past o-ring 153" and radially offset o-ring 153' into conduit 150 and out nozzle 154 during the spray phase. Diaphragm 140 comprises an annular plate that is biased towards the closed position illustrated in FIG. 6.

Diaphragm 140 is movable between the first closed position and a second open position (not shown) to activate the dispenser 110 at predetermined intervals. The radially inner edge of diaphragm is integrally connected to conduit 150.

Once dispenser is turned "ON", an accumulation phase is initiated, in which the pressurized gas propellant flows from the can 112 downstream through cavity 114 and into channel 146. The propellant then travels into the inlet 138 of accumulation chamber 136 via aperture 171 extending through orifice plate 136.

The active flows through conduit 123, and around seal 144 into channel 128, where it continues to travel towards outlet channel 151. However, because plug 164 is disposed at the mouth of channel 151, the active is unable to travel any further during downstream.

During the accumulation phase, the constant supply of gas propellant flowing from intake channel 146 into the accumulation chamber 136 causes pressure to build therein, and such pressure acts against the inner surface of diaphragm 140. Once the accumulation chamber 136 is sufficiently charged with gas propellant, such that the pressure reaches a predetermined threshold, the mono-stable diaphragm 140 becomes deformed from the normal closed position illustrated an open position.

This initiates a spray phase, during which the diaphragm 140 causes conduit 150 to become displaced axially outwardly. As conduit 150 becomes displaced outwardly, plug 164 becomes removed from channel 128. Accordingly, because the inner diameter of retainer wall 142 increases as plug 152 travels downstream, the active mixture is permitted to travel from conduit 128, around the plug, and into outlet channel 151. The pressurized active then travels from channel 151 and out the nozzle 154 as a spray.

Stored propellant further exits accumulation chamber 136 via nozzle 154 as described above. The stored propellant and active thus merge inside dispenser 10 and exit as a single stream. Because more gas propellant exits accumulation chamber 136 than propellant that enters via orifice plate 168, the pressure within the accumulation chamber quickly abates during the spray phase.

Once the pressure within chamber 136 falls below a predetermined threshold, the diaphragm 140 snaps back to its normal closed position, re-establishing the seal formed by plug 164 with respect to channel 128. Accordingly, active mixture is once again prevented from exiting the dispenser, while gas propellant continues to flow into the accumulation chamber 136 in the manner described above to initiate the next spray phase. The cycle is automatic and continuously periodic until the propellant is exhausted.

It should be further appreciated that diaphragm 140 could be bi-stable or, alternatively, a biasing member may be provided that maintains diaphragm 140 in the open configuration. Accordingly, once a sufficient amount of propellant accumulates inside accumulation chamber 136, diaphragm will be biased to the open configuration described above. However, instead of returning to its closed configuration once pressure inside accumulation chamber 136 abates, diaphragm 140 will stay in the open configuration, thereby allowing active to continuously exit nozzle 154 from can.

This is referred to as a "total release" system. It should be appreciated that dispenser 10 could alternatively provide a total release of aerosol content as described in the previously mentioned U.S. patent application Ser. No. 10/236,364. Preferably, in the device described in the Ser. No. 10/236,364 application, membrane 130 and orifice plate 168 would be positioned as described herein to achieve the aforementioned advantages.

Figure 9:
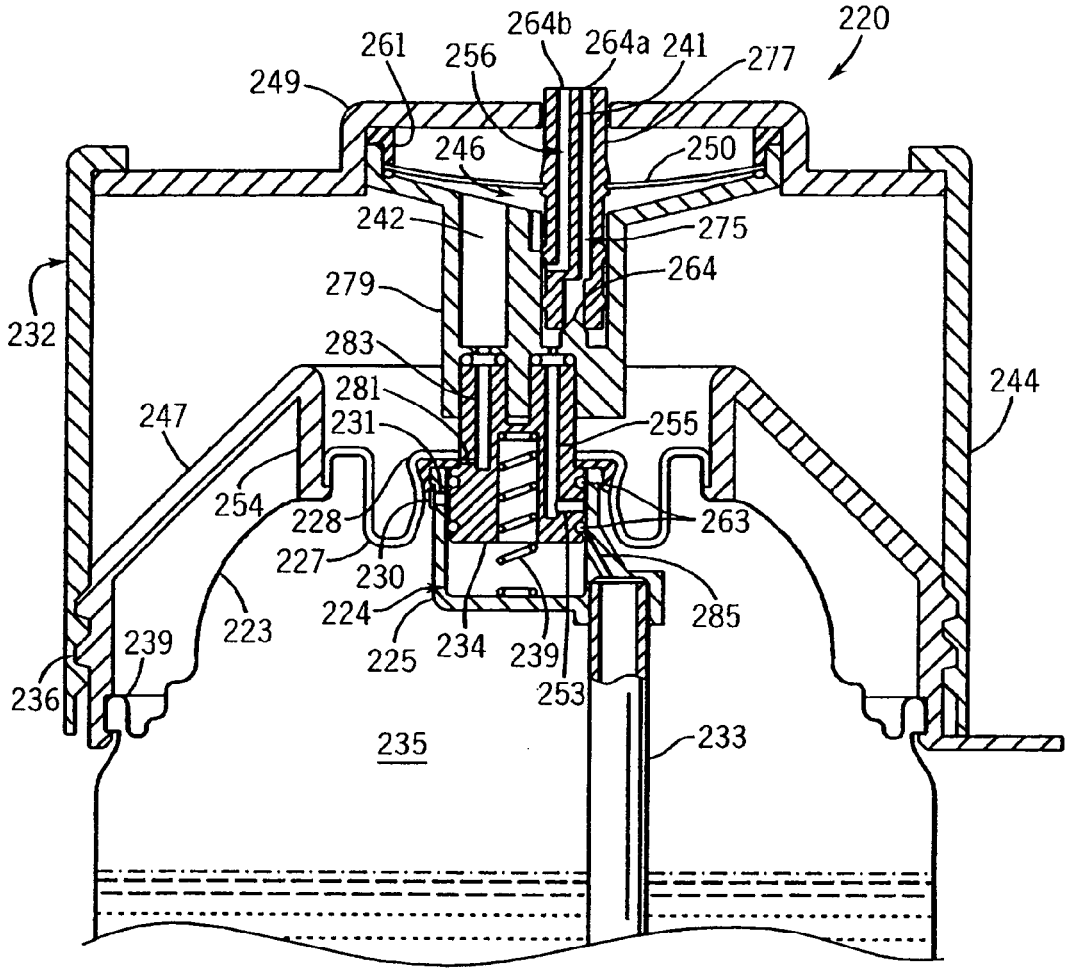
FIG. 9 is a sectional view of an automatic dispensing valve assembly of still another embodiment, in an "off" configuration.
Figure 10:
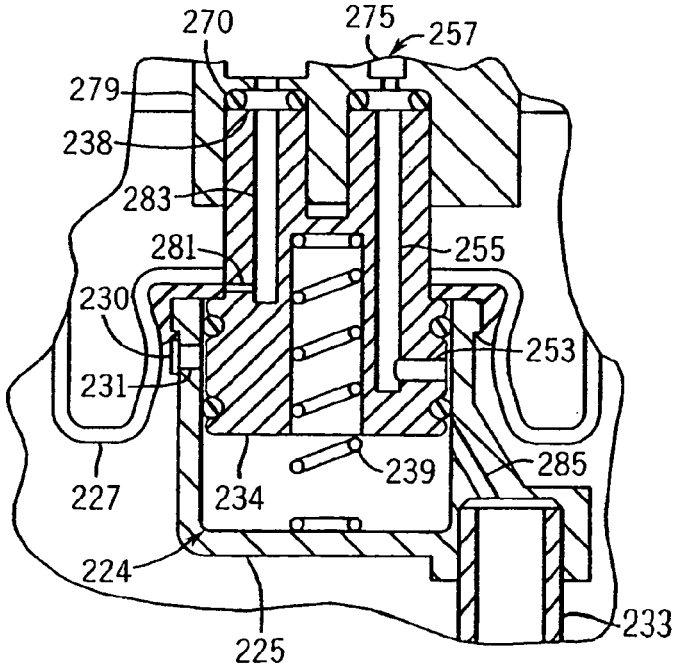
FIG. 10 is an enlarged view of a part of the valve assembly of FIG. 9.
Figure 11:
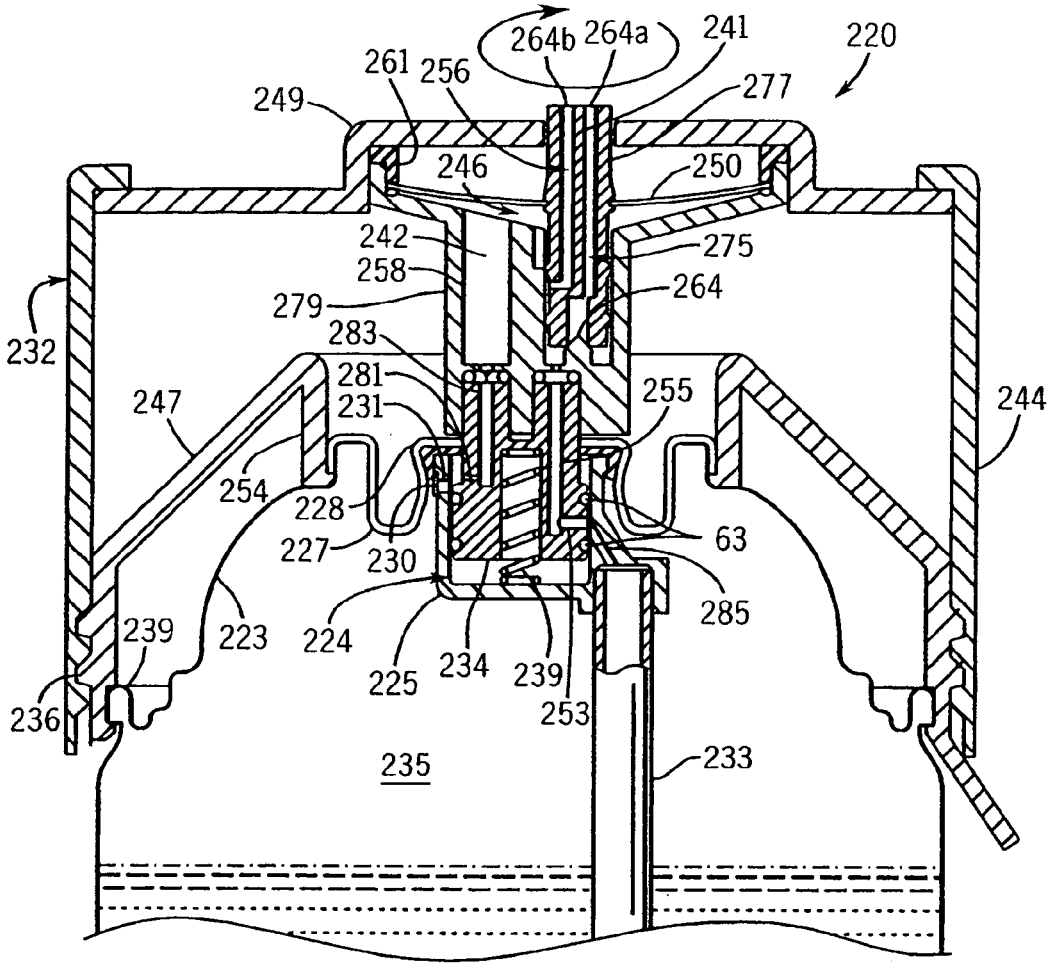
FIG. 11 is a view similar to FIG. 9, but with the valve in an "on" configuration during the accumulation phase of the dispensing cycle.
Figure 12:
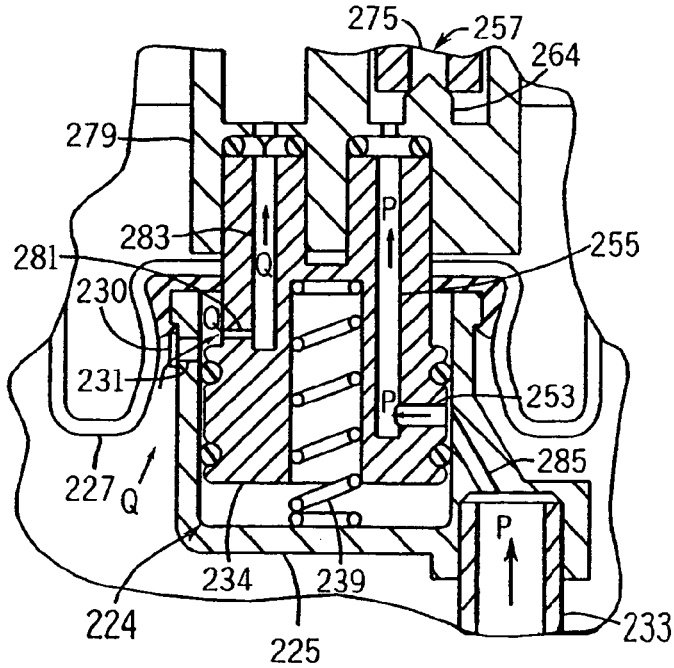
FIG. 12 is an enlarged view of a valve portion of the valve assembly of FIG. 11.
Figure 13:
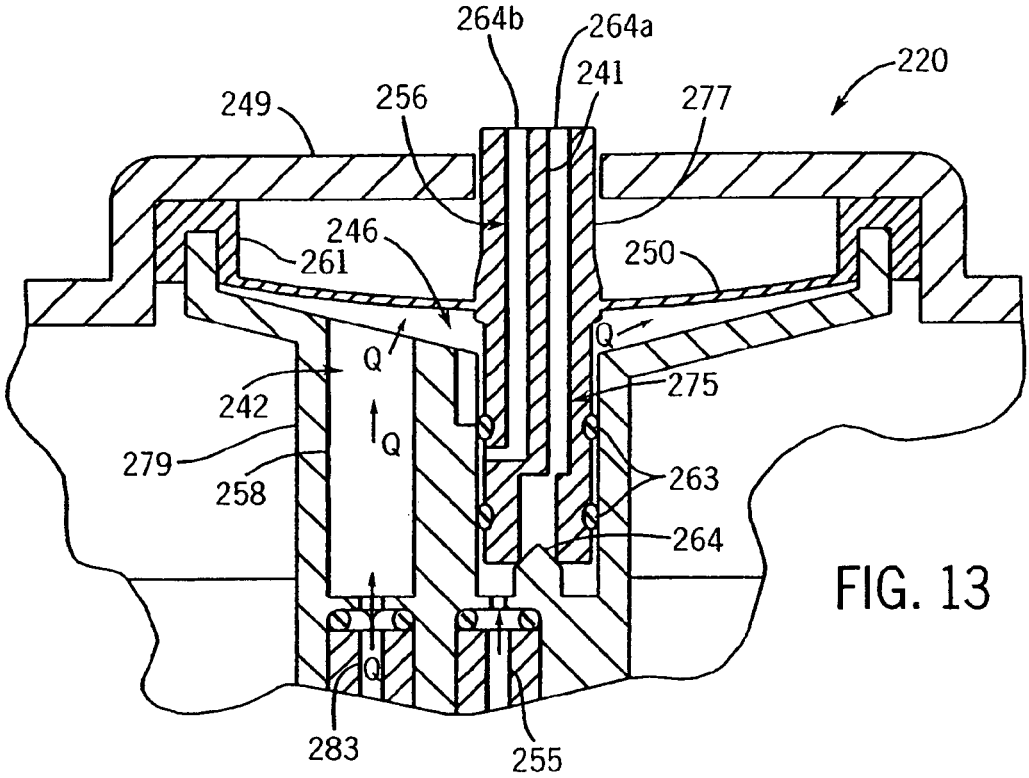
FIG. 13 is an enlarged view of the accumulation chamber portion of the valve assembly of FIG. 11.
Figure 14:
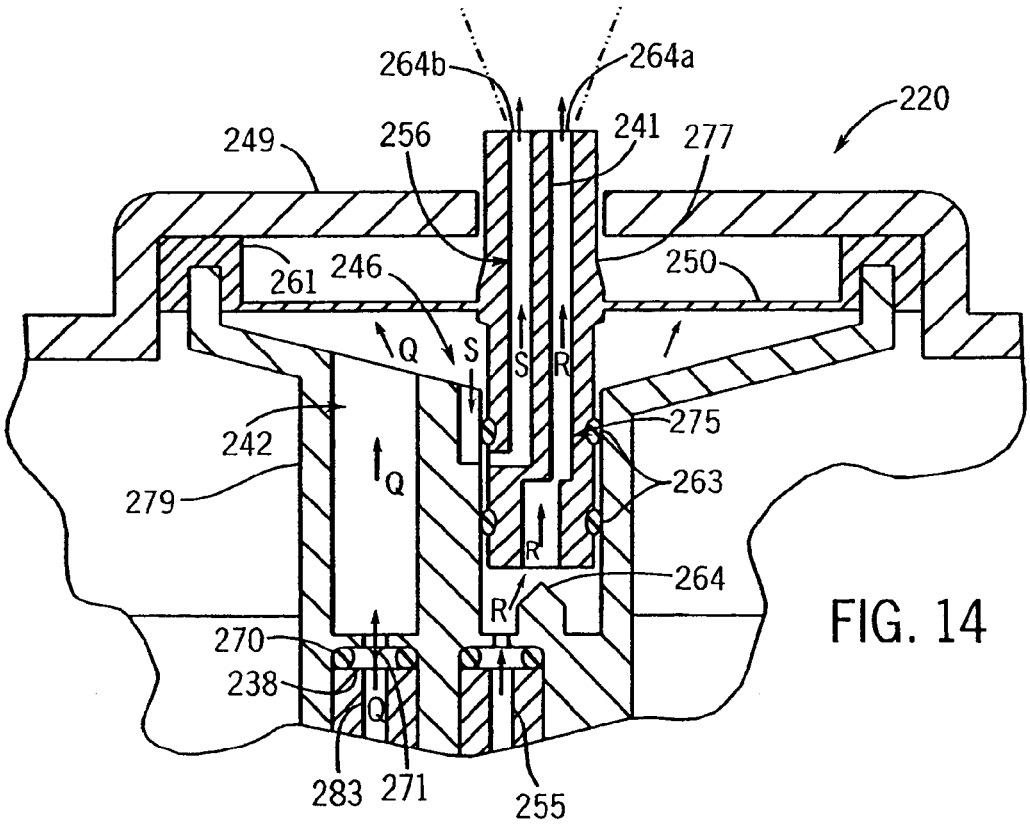
FIG. 14 is a view similar to FIG. 13, but with the valve in the spray phase of the dispensing cycle.

Referring now to FIGS. 9 and 10, a dispenser 220 in accordance with yet another embodiment is mounted onto can 222 in the same manner as described above in accordance with the previous embodiment. However, a spring 239 is seated within annular member that biases tee 234 axially outwardly and against the cup 227.

Tee 234 is disposed within the cavity 224. Annular member 225 defines a channel 285 that extends from conduit 233 into conduit 224. Housing 234 defines a first conduit 253 that extends partially there through in the radial direction, and terminates at an axially extending conduit 255. Conduit 255 is in fluid communication, at its axially outer end, with a conduit 275 that extends axially out the dispenser as an active chemical outlet 264*a*. Conduit 275 is defined by an axially extending annular wall 277 in combination with an axially extending separator 241. However, when the dispenser is either "OFF" or in the accumulation phase, a plug 264 blocks the entrance into conduit 275. Furthermore, when the dispenser 220 is in the "OFF" position, conduits 285 and 253 are not in radial alignment.

Annular member 225 further defines a propellant intake channel 231 extending radially there through and in fluid communication with upper region 335 of can 222. Intake channel 231 is covered by a fluid filter membrane 230 of the type described above. Tee 234 defines a channel 281 extending partially there through in the radial direction, and terminates at the axially upstream end of an axially extending conduit 283. Conduit 283, at its axially outer end, is in fluid communication with a conduit 242 that opens into accumulation chamber 246. An orifice plate 238, of the type described above, is disposed at the interface between conduits 283 and 242. However, when the dispenser is in the "OFF" position, conduits 231 and 281 are not aligned.

An annular seal 228 is disposed around the periphery of tee 234, and positioned between wall 225 and cup 227. A pair of o-rings 263 are disposed at the radial interface between walls 225 and 234 at a position axially inwardly and outwardly of channels 253 and 231. The seal 228 and o-rings 263, in combination with the offset of the propellant and active channels, described above, prevents the flow of active and propellant into dispenser 220 when the dispenser is in the "OFF" position.

Referring now to FIGS. 11–14, when the dispenser 220 is turned "ON" by rotating the control assembly 232, the accumulation phase begins whereby tee 234 is displaced axially upstream against the force of spring 239. Accordingly, channel 253 thus becomes radially aligned with channel 285, and active chemical flows into dispenser 220 along the direction of arrow P. However, because plug 264 is blocking the entrance into channel 275, propellant is prevented from exiting the dispenser 220 during the accumulation phase.

As tee 234 is displaced, channel 281 is moved into radial alignment with channel 231, thereby enabling propellant to travel along the direction of arrow Q into and through conduit 283 and orifice plate 238, and into accumulation chamber 246 via channel 242 and orifice 271. Propellant accumulates in chamber 246 until the pressure reaches a predetermined threshold, at which point the diaphragm 250 is deformed from the closed position to the open position illustrated in FIG. 14.

When the diaphragm 250 flexes axially downstream to the open position, walls 277 and 241 are also displaced axially downstream. Accordingly, the inlet to channel 275 is displaced from the plug, and active chemical is able to flow from channel 255 into channel 275 and out the active chemical outlet 264*a* as a "puff." Propellant also travels from accumulation chamber 246, through a gap formed between wall 279 and 277, into channel 266, and exits dispenser via propellant outlet 264*b* as a separate stream from the active chemical. Once pressure within the accumulation chamber 246 abates, diaphragm 250 closes to initiate another accumulation phase.

The above description has been that of preferred embodiments of the present invention. It will occur to those that practice the art, however, that many modifications may be made without departing from the spirit and scope of the invention. In order to advise the public of the various embodiments that may fall within the scope of the invention, the following claims are made.

INDUSTRIAL APPLICABILITY

The present invention provides automated dispenser assemblies for dispensing aerosol can contents without the use of repeated electric power or manual activation, and with reduced risk of clogging.

We claim:

1. A valve assembly that is suitable to dispense a chemical from an aerosol container that has a first region with a gas propellant and a second region with an active chemical, the valve assembly being of the type that can automatically transition from an accumulation phase where the gas propellant is received from the container, to a spray phase where the active chemical is automatically dispensed, the valve assembly comprising:

a housing mountable on an aerosol container;

a movable diaphragm associated with the housing and linked to a seal, the diaphragm being biased towards a first configuration;

an accumulation chamber inside the housing for providing variable pressure against the diaphragm;

a first passageway in the housing suitable for linking the first region of the aerosol container with the accumulation chamber;

a fluid filter adjacent to an inlet to the first passageway inhibiting liquid stored in the container from entering the first passageway;

an orifice plate disposed in the first passageway to regulate the flow of gas therethrough;

a second passageway linking the second region with an outlet of the valve assembly;

whereby when the diaphragm is in the first configuration the seal restricts the flow of the active chemical out of the valve assembly; and whereby when the pressure of gas propellant inside the accumulation chamber exceeds a specified threshold the diaphragm can move to a second configuration where active chemical is permitted to spray from the valve assembly.

2. The valve assembly as recited in claim 1, wherein the diaphragm will shift back to the first configuration from the second configuration when pressure of the gas propellant in the accumulation chamber falls below a threshold amount.

3. The valve assembly as recited in claim 1, wherein the accumulation chamber will at least partially exhaust the gas propellant when the diaphragm is in the second configuration.

4. The valve assembly as recited in claim 3, wherein the gas propellant and active chemical mix in the valve assembly prior to exiting the valve assembly.

5. The valve assembly as recited in claim 3, wherein the active chemical and gas propellant exit the dispenser as separate streams.

6. The valve assembly as recited in claim 1, wherein the fluid filter is hydrophobic.

7. The valve assembly as recited in claim 6, wherein the fluid filter is oleophobic.

8. The valve assembly as recited in claim 1, wherein the orifice plate further comprises at least one orifice having a smallest dimension between 0.2 micron and 0.45 micron.

9. The valve assembly as recited in claim 8, wherein the orifice plate comprises an electroplated nickel.

10. The valve assembly as recited in claim 1, wherein the orifice plate further comprises at least one orifice having a smallest cross-sectional area between 0.03 and 0.16.

11. The valve assembly as recited in claim 10, wherein the orifice plate comprises an electroplated nickel.

12. The valve assembly as recited in claim 1, wherein the active chemical is selected from the group consisting of insect repellents, insecticides, fragrances, sanitizers, and deodorizers.

13. A method of automatically delivering an active chemical from an aerosol container to an ambient environment at predetermined intervals, the method comprising the steps of:

(a) providing a valve assembly suitable for use to dispense an active chemical from an aerosol container that has a first region with a gas propellant and a second region with an active chemical, the valve assembly being of the type that can automatically transition from an accumulation phase where gas propellant is received from the container, and a spray phase where the active chemical is automatically dispensed without the use of electrical power, the valve assembly comprising:

(i) a housing mountable on an aerosol container;

(ii) a movable diaphragm associated with the housing and linked to a seal, the diaphragm being biased towards a first configuration;

(iii) an accumulation chamber inside the housing for providing variable pressure against the diaphragm;

(iv) a first passageway in the housing suitable for linking the first region of the aerosol container with the accumulation chamber;

(v) a fluid filter coupled to an inlet to the first passageway preventing liquid stored in the container from entering the first passageway;

(vi) an orifice plate disposed in the first passageway to regulate the flow of gas therethrough;

(vii) a second passageway linking the second region with an outlet of the valve assembly, whereby when the diaphragm is in the first configuration the seal can restrict the flow of the active chemical out of the valve assembly; and whereby when the pressure of the gas propellant inside the accumulation chamber exceeds a specified threshold the diaphragm can move to a second configuration where active chemical is permitted to spray from the valve assembly;

(b) mounting the valve assembly to such an aerosol container; and (c) actuating the valve assembly.

* * * * *